United States Patent [19]

Mannbro

[11] Patent Number: 4,595,455

[45] Date of Patent: Jun. 17, 1986

[54] METHOD FOR CONTROLLING BATCH ALKALINE PULP DIGESTION IN COMBINATION WITH CONTINUOUS ALKALINE OXYGEN DELIGNIFICATION

[75] Inventor: Nils V. Mannbro, Asarum, Sweden

[73] Assignee: Mannbro Systems Handelsbolag, Karlshamn, Sweden

[21] Appl. No.: 299,564

[22] Filed: Sep. 4, 1981

Related U.S. Application Data

[63] Continuation of Ser. No. 69,184, Aug. 23, 1979, abandoned, which is a continuation of Ser. No. 890,483, Mar. 27, 1978, abandoned, which is a continuation of Ser. No. 736,886, Oct. 29, 1976, abandoned, which is a continuation-in-part of Ser. No. 523,873, Nov. 14, 1974, abandoned.

[30] Foreign Application Priority Data

Nov. 23, 1973 [SE] Sweden ..... 7315894

[51] Int. Cl.[4] ..... D21C 7/12; D21C 9/147; D21C 11/00

[52] U.S. Cl. ..... 162/38; 162/62; 162/65

[58] Field of Search ..... 162/49, 62, 65, 238, 162/38

[56] References Cited

U.S. PATENT DOCUMENTS 2,671,727 3/1954 Westcott et al. ..... 162/62
3,830,688 8/1974 Mannbro ..... 162/65
3,843,473 10/1974 Samuelson et al. ..... 162/65

FOREIGN PATENT DOCUMENTS 2252440 6/1975 France .
0432183 5/1976 Spain .

*Primary Examiner*—Steve Alvo
*Attorney, Agent, or Firm*—Young & Thompson

[57] ABSTRACT

A method for batch pulp digestion with hydroxide-bearing cooking liquors in combination with continuous alkaline oxygen delignification is described. The brown stock washing plant and the connected oxygen stage are freed from oxygen-consuming black liquid by withdrawing black liquor from a pre-cook wherein cooking liquor is reacted with a surplus of hydroxide-consuming chips. Moreover, spent cooking liquor in the brown stock washing plant is displaced with spent liquor from the oxygen delignification stage (oxy-liquor) and/or alkalization spent liquor (bleaching spent liquor worth recovering because of its sodium content). A mixture of said liquors is prepared in a pressurized cooking liquor accumulator and charged to the digestion plant liquor circulation system. The cooking liquor's content of hydroxide for lignin release is continuously replenished by means of white liquor dosage which also compensates the dilution which is caused by the supply of oxy-liquor and other bleaching spent liquors whose hydroxide content reflects variations in the preceding digesting conditions pertaining to the cooking liquor and resulting Kappa number fluctuations.

7 Claims, 1 Drawing Figure

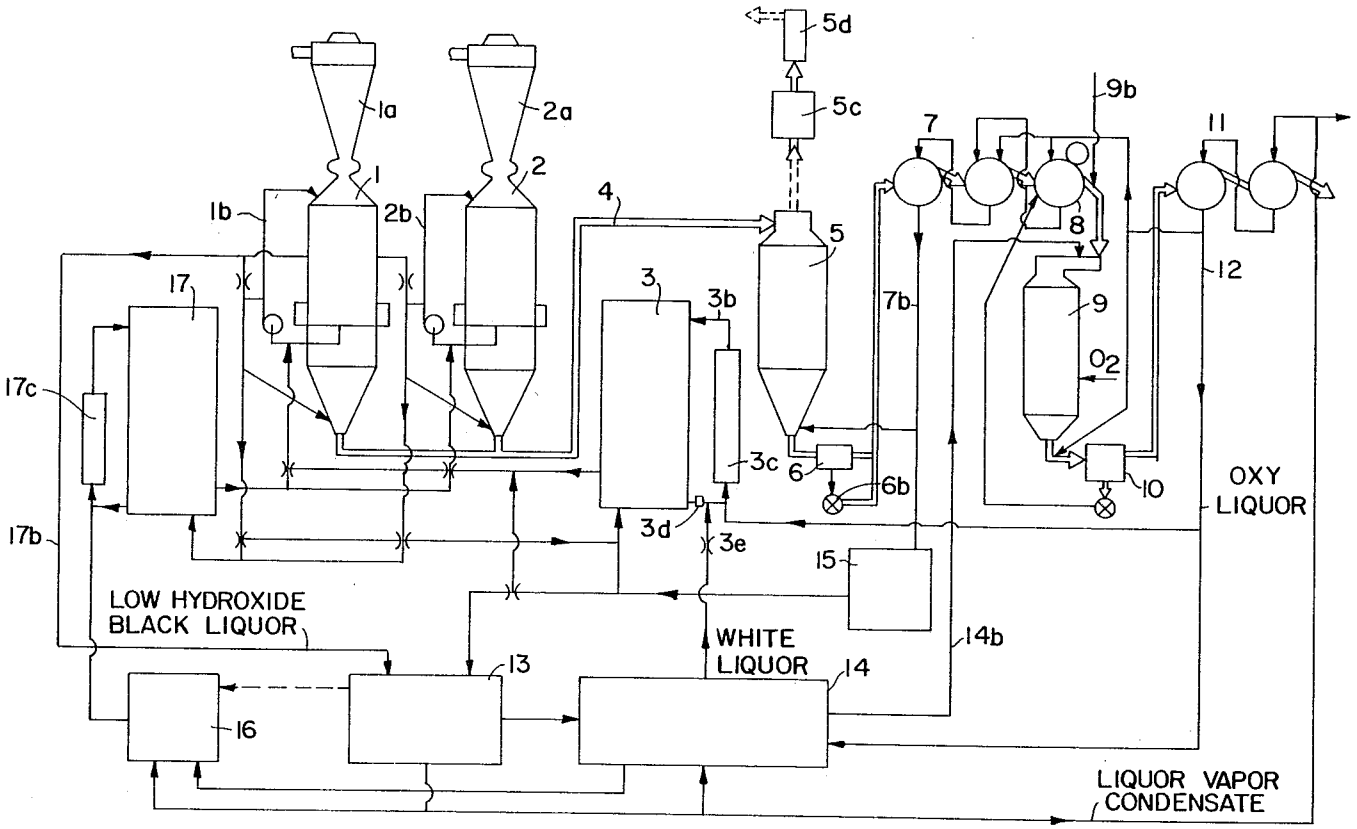
OXY LIQUOR
LIQUOR VAPOR CONDENSATE
WHITE LIQUOR
LOW HYDROXIDE BLACK LIQUOR
O2
1
1a
1b
2
2a
2b
3
3b
3c
3d
3e
4
5
5c
5d
6
6b
7
7b
8
9
9b
10
11
12
13
14
14b
15
16
17
17b
17c

METHOD FOR CONTROLLING BATCH ALKALINE PULP DIGESTION IN COMBINATION WITH CONTINUOUS ALKALINE OXYGEN DELIGNIFICATION

This application is a continuation of Ser. No. 069,184 filed on Aug. 23, 1979 and now abandoned, which in turn is continuation of Ser. No. 890,483 filed on Mar. 27, 1978 and now abandoned, which is a continuation of Ser. No. 736,886 filed on Oct. 29, 1976 and now abandoned, which is a continuation-in-part of Ser. No. 523,873 filed Nov. 14, 1974 and now abandoned.

The delignification of pulp with oxygen and alkali forms an important link between the pulping of the lignocellulose raw material, e.g. kraft pulping of wood chips, and the traditional bleaching of the digested pulp. Oxygen delignification is advantageously applied to pulp with a higher Kappa number than pulp intended for traditional delignification with chlorine bleaching agents and thereby permits less complete lignin release in the initial digesting step. On the other hand the margin for the actual oxygen delignification is narrowed if the cellulose is to be well protected from simultaneous degradation before a continued bleaching in additional bleaching steps with oxygen and/or chlorine compound bleaching agents.

To determine to what extend the delignification agents also have degraded the cellulose, the intrinsic viscosity, expressed in $cm^3/g$, is normally used as a measure of the degree of depolymerization of the cellulose. In this connection it is a common practice to attempt to hold for example the intrinsic viscosity of the kraft pulp at approximately 800–900 $cm^3/g$ after the oxygen step. For delignification with oxygen, also known in the art as alkali-oxygen bleaching, an optimal value of the ratio $$\text{Kappa number reduction/Loss of viscosity} \quad (1)$$

is thus sought. Such optimization is effected by washing the pulp free from released wood substances in the cooking spent liquor, i.e. black liquor, to a sufficient degree and by using alkali in the oxygen step which is sufficiently free from $Na_2S$. If the expression (1) above is to be optimal, in the oxygen step a low value is required for the ratio $$\text{[Oxygen-consuming substance]/[Hydsoxide] or [OCS]/[OH]} \quad (2)$$

of the cooking spent liquor.

For optimal application of the oxygen delignification possibilities for both better utilization of the wood raw material and environmental protection, digestion control is required at such high Kappa number levels that variations in liquor charge and wood moisture result in relatively large Kappa number fluctuations both in continuous and in batch digesting.

In continuous digesting the black liquor solids can be displaced by the washing liquid inside the digester according to Swedish Pat. No. 227,464, whereby a combination of pulp qualities suitable for oxygen delignification is obtained.

Batch digesting is more difficult to control. With the aid of a relative reaction rate called the H-factor, which is well known and in a single variable expresses the accumulated effect of reaction time and temperature, systems have been developed for digester control based on analysis of the cooking liquor hydroxide concentration (content of delignifying alkali) during an individual batch cook in progress. A well-known method of measuring the cooking liquor conductivity or on the other hand, automated titrimetric analysis based on the measuring of conductivity (U.S. Pat. No. 3,886,034) may be advantageously used for calculating the value of the H-factor which will govern the rate of the alkaline delignification reactions in each (separate) batch digester, said reactions resulting in the predetermined Kappa number of the pulp from the various digestions.

An alternative to successive control of each cook in progress is to hold the charge conditions of all cooks constant. Such conditions are facilitated by an automated batch digester operation which is used at several new sulphate mills and has been developed from the so-called Kaukas-automatic system (Sjoberg, G: Svensk Papperstidning, Vol. 75, 1972, p. 475). The chip charge to each digester is measured by volume by filling under constant conditions. The same chip moisture equilibrium is set from cook to cook by steaming and the steaming condensate which smells only of wood and contains an amount of water-soluble wood substances, easily lends itself to recovery. Equalization of large variations in mixtures of different chip assortments can however require longer steaming times than the digestion routines or the production pace allow.

The automatic system does not function at its best if incompletely digested material, knots, etc., from preceding cooks are returned during chip filling. Thus the steaming condensate is additionally contaminated by the black liquor which accompanied said knots. Nor does automatic digesting lend itself to transport of knots by means of black liquor to filled and steamed digesters.

Automated digesting therefore requires that the knots and/or incompletely digested material afterwards must either be disintegrated so that they can be delignified with pulp bleaching agents or discarded. Subsequently-formed screening rejects from brown (unbleached) stock are also, according to know methods, confined to refining and possibly re-screening for recycle of at least the better fraction thereof to acceptable brown stock obtained from previous screening steps. Closed screening systems, where all rejects are disintegrated and returned to the brown stock for common final washing and direct transfer to the first bleaching step, have been shown to give residues, so-called shives which contrast with bleached fiber from traditional bleacheries with chlorine bleaching agents. According to U.S. Pat. No. 3,830,688 it is already known that gas phase, i.e. high density pulp, delignification of re-digested and/or disintegrated screenable coarser material is more effective than water suspension chlorination for the elimination of shives. Especially oxygen delignification of brown stock is thus a valuable complement to automated batch digesting.

Automated batch digesting can with regard to liquor charging be further improved if each digester's separate system of calorizator and in part even cooking liquor circulator is replaced with a cooking liquor accumulator common to several digesters. Consequently this arrangement has been called multiple digestion.

U.S. Pat. No. 2,671,727 (Westcott et al.) dealt with multiple digestion maintaining constant hydroxide concentration in the cooking liquor by means of conductivity-controlled white liquor dosage to the cooking liquor accumulator, but separate cooking liquor heaters were retained in the circuit for each digester. Favorable values were reported for the ratio Dissolved wood lignin/Cellulose viscosity (3)

by means of successive white liquor dosage for maintenance of an alkalinity adapted to temperature, for example 145°–175° C., and digesting time. The integrated effect of temperature and time at a certain hydroxide concentration (alkalinity) is, as mentioned, currently expressed as the H-factor of the cook.

The patent, however, totally fails to deal with how the cooking liquor and black liquor left in the finished cook are washed from the brown stock and with the effect of the quantity of unconsumed hydroxide which is led off with the liquor mixture to the regeneration plant.

For batch cooking—without multiple digestion—U.S. Pat. No. 2,639,987 (Sloman) describes a two-step process which implies that only black liquor is added to the chip-filled digester in the first step to consume the remaining hydroxide before the black liquor is recovered. The result of this is that there is a saving in the white liquor charge to subsequent cooks. A further development of Westcott's and Sloman's processes is discussed in Swedish Pat. No. 227,464 (1956) by the present inventor; the claims therein are, however, limited to continuous digestion as also is taught in Sloman's U.S. Pat. No. 3,097,987. The principle of digestion in pre-cook and main cook is also dealt with in Swedish Pat. No. 227,464.

The present invention relates to multiple operation of automated batch digesters in combination with continuous alkaline oxygen delignification of pulp, for example with application of the principle for reducing polluting discharge as revealed in U.S. Pat. No. 3,830,688. Of particular importance in this connection is how the spent liquor from a continuous oxygen step is transferred to the liquor system of the discontinuous digesters.

In order to facilitate comprehension of which pulps and liquors are intended in the present case, the following terms and numbers in parenthesis, referring to the attached drawing, have been used:

brown stock=pulp which has been delignified only by cooking liquor in digesters 1,2.

raw brown stock=brown stock as blown or flushed from a digester by the aid of blow liquor through blow line 4.

cooking liquor=the composite delignifying liquor for actual digestion (from 3 through 1*b* or 2*b* and recycled to 3).

black liquor=spent cooking liquor (called "low hydroxide black liquor" on the accompanying drawing) from a pre-cook and from which liquor hydroxide is regenerated in a subsequent step (13,14).

blow liquor=cooking liquor blown with raw brown stock (4) and recycled (7*b*,15) to the cooking liquor system (3).

oxy-stock=obtained by oxidizing brown stock with oxygen in a reactor 9. This material is also known in the art as oxygen-alkali bleached pulp.

oxy-liquor=spent liquor (12) from the oxygen delignification stage (9). This material is also known in the art as waste liquor from the oxygen-alkali process.

alkalization spent liquor=bleaching spent liquor (bleach plant effluent) worth recovering because of its sodium content, fed to 11.

soda brown liquor=obtained by dissolving (14) regenerated (soda) smelt (13) in oxy-liquor (12) or alkalization spent liquor.

brown liquor=causticized soda brown liquor (used for cooking instead of white liquor (from 14 to 3 through 3*e*).

Note: "Brown stock washing" implies the washing of liquor substances out of liquor-containing brown stock or raw brown stock. "Brown stock washing" is not relevant to the oxy-stock, i.e. after the brown stock and the accompanying liquor remains have been oxidized. Therefore, it is erroneous to talk about "integration of the oxygen stage in the brown stock washing system", a writing style which has been used on several occasions. More appropriately "oxy-stock washing" follows the oxygen stage.

The following were set as goals for the invention:

(1) there should be only a small amount of accompanying oxygen-consuming black liquor substances with brown liquor charged to the digestion and therefrom entrained to the oxygen stage;

(2) only a small dilution of the black liquor by liquors introduced in the brown stock washing plant;

(3) optionally allowing a remainder of hydroxide with brown stock from washing plant to the oxygen delignification step but preferably without accompanying sulphide;

(4) practically negligible losses of hydroxide with black liquor passed to combustion in the alkali (hydroxide) regeneration plant;

(5) maximum re-use within the process of oxy-liquor and bleach plant alkalization effluent for chemical regeneration and environmental protection;

(6) control of limits for dilution of cooking liquor with oxy-liquor and/or bleach plant effluent;

(7) controlled, preferably low, sulphidity during the main cook but optimal utilization of sulphide compounds for yield-increasing pre-cook;

(8) under all circumstances sufficient sulphidity for reaching optimal balance between yield and pulp strength;

(9) minimum formation of contaminating condensate from the combined spent liquor evaporation plant;

(10) greatest possible retention of all various spent liquors within the process.

According to the invention the brown stock washing plant and the connected oxygen stage are freed from oxygen-consuming substance by (a) removing the black liquor from a pre-cook with a surplus of hydroxide-consuming chips in relation to the amount of hydroxide supplied by oxy-liquor and cooking liquor;

(b) displacement of blow liquor in the brown stock washing plant with oxy-liquor and/or alkalization spent liquor and using a mixture of said liquors for charging liquor to digesters or the digestion plant liquor system;

(c) continuous regulation of the circulating cooking liquor content of hydroxide for lignin release by means of white liquor dosage which is controlled according to the dilution which is caused by the supply of spent liquors whose hydroxide content reflects variations in digesting conditions and thereby caused Kappa number fluctuations;

(d) using a tank that is a combined mixer and cooking liquor accumulator, which during part of or all of the main cooking stage is integrated with the pressurized circulation system of the digesters, so as to provide continuous regulation of the composition of the mixed cooking liquor.

BRIEF DESCRIPTION OF THE DRAWING

The attached drawing shows the application of the invention schematically.

The plant may comprise several batch digesters, of which 1 and 2 are shown with the chip cones 1*a* and 2*a*. Such digesters of 225 $m^3$ capacity are in operation in the newest kraft mill in Sweden where eight digesters automatically produce approximately 900 tons of brown stock per day. A cooking liquor circulation system 1*b* and 2*b*, respectively, is associated with each digester but no separate cooking liquor heaters are included. Instead, the circulation system 3*b* of the cooking liquor accumulator 3 is equipped with a central heat exchanger 3*c*.

The hydroxide concentration of the cooking liquor is measured and regulated at 3*d*, 3*e* by means of automated titration, by way of example, by measurement of conductivity or alternately pH measurement. The predetermined hydroxide concentration is maintained through injection via the dosage valve 3*e* of regenerated cooking chemicals.

The conduit and valves connecting the digesters 1 and 2 with the accumulators 3 and 17 can as needed be designed for circuits other than as shown in the drawing as an example.

Raw brown stock is blown with blow liquor in line 4 to the blow tank 5. Of the blow liquor 7*b* reclaimed from the brown stock washing plant 7, a fraction is used for transport of the pulp from the blow tank 5 through coarse screening 6 of the raw brown stock. Knots and other incompletely pulped rejects are carried through a disintegrator 6*b* and are returned, optionally following a screening not shown here, for washing in the brown stock washing plant. The brown stock washing is terminated with a liquor recovery in a press 8 which gives the pulp the concentration necessary for making a moving bed of fluffed brown stock of approximately 30% consistency, whereby the oxygen reactor 9 operates. Oxy-stock from the reactor is treated in a closed screening plant 10 for separating incompletely delignificated material and impurities. This screening plant can be furnished with other screening and cleaning steps than are shown in the drawing so that oxy-stock rejects having fiber value are returned to the brown stock while knot cores, bark remains, etc. are rejected as intact as possible. Thereafter the screened oxy-stock is concentrated and washed in the washing plant 11.

In the oxy-stock washing plant the oxy-liquor is displaced with water in an available form, such as liquor vapor condensate, alkalization effluent or surplus white water from a paper mill. The oxy-liquor 12 is used preferably in the brown stock wash 7 while the residue of oxy-liquor is led directly to the hydroxide regeneration plants 13 and 14, and possibly also the the cooking liquor accumulator 3.

Regenerated hydroxide can be led through the line 14*b* to the oxygen reactor 9. The supply of hydroxide (alkali) can alternatively come through line 9*b*. Processing of caustic soda liquor for bleaching is disclosed in published Swedish patent application No. 360,129. The addition of other chemicals can also take place via this line.

According to the invention a plurality of liquors is mixed in the accumulator: black liquor, white liquor, oxy-liquor with blow liquor from the pulp stock washing steps.

Brown liquor may replace some white liquor and is produced in the causticizing plant 14. The brown liquor is obtained by dissolving regenerated soda from the black liquor combustion 13 in oxy-liquor. The soda brown liquor thus obtained is causticized to brown liquor. This re-use of the water in solutions containing dissolved delignification products takes place according to the Silfate-principle (U.S. Pat. Nos. 2,738,270; 2,734,037 and 3,003,908). Blow liquor recycle to the cooking liquor and the regulation of the cooking liquor alkalinity hydroxide concentration to a constant value take place continuously whilst the dosage of white or brown liquor is effected according to the requirements of the intermittent digesters 1 and 2.

The cooking liquor is circulated in the accumulator for mixing and heating by means of steam 3*c*. The temperature of the cooking liquor is normally kept between 150° and 180° C. depending on which hydroxide concentration (alkalinity) is held in the cooking liquor for intended pulp quality. (The heating of the cooking liquor can also take place by means of direct steam injection or heating of cooking liquor by flue gas in a loop of boiler tubes.)

The accumulator is held at essentially constant pressure and temperature conditions, which are determined by the main cooking stage in the digesters, although these main cooks contain lignocellulose material of different Kappa numbers. Black liquor solids from individual cooks is thus distributed to the common cooking liquor which is supplied by a flow of oxy-liquor and a dosage of white liquor hydroxide is injected.

During the actual delignification or main cook, the digester 1 or 2 is percolated by cooking liquor from the accumulator 3 by means of a circulation pump of the digester and/or accumulator. When the required degree of brown stock delignification, i.e. Kappa number is reached, some of the cooking liquor is drawn off to the accumulator 3 and the digester is further pressure-relieved so that the required liquor volume and digester pressure is left for the blowing of its content to the blow tank 5. It is also possible to recycle blow liquor from the container 15 during the blow to lower the temperature of the cooking liquor expanding in the blow tank 5. In this way, pressure waves are damped in the condenser system 5*c* and the venting apparatus or device 5*d* for combustion, scrubbing and/or other gas converting connected thereto. The blow vapors can also be condensed directly in spent liquors from the process. Alternatively oxygen can be injected into the digester or blow line 4 so as to reduce odor discharge, but these arrangements are not shown here.

The liquor volume in the system comprising digester, liquor accumulator and wash stage increases through the admission of water with moist chips and liquors. An outlet must therefore be provided for the black liquor to evaporation plant 13 in the hydroxide regeneration system. However, hydroxide loss with the black liquor shall be prevented to the greatest extent, for which reason it is consumed in a pre-cook, alternatively an intermediate cook, by chips charged for the main cook. Therefore a digester loaded with chips is filled with liquor from the container 15 and/or the liquor accumulator 3. In case the thus-obtained black liquor is to be circulated, a circuit for each digester may be used. The chips consume the hydroxide quickly even at temperatures lower than the temperature in the main cook, for example at 90° to 100° C. When the hydroxide is utilized and the black liquor produced, it is drawn off and passed to the evaporation plant. Sulphide-bearing black liquor thus produced is more disposed to emit hydrogen sulphide if oxidation has not taken place for example in connection with the blowing off of the cook. Oxidation of the black liquor sulphide compounds with oxygen during some phase of the pretreatment of the chips with black liquor is attractive since it releases hydroxide. If the steam vapor normally used in for example the Svensson system for chip filling is replaced by vapor-emitting black liquor according to the Tarkonen system, it is particularly suitable to use some cooking liquor from the accumulator 3 for this purpose, which liquor is then in part drawn off to the black liquor evaporation 13. The remaining black liquor substances in the digester are then dispersed in additional cooking liquor supplied from the liquor accumulator.

The required white liquor volume is reduced by the pre-cook for complete utilization of the hydroxide and this facilitates re-use of a larger volume of oxy-liquor in the digestion via the brown stock washing.

In a conventional cook, the hydroxide content in the cooking liquor at the start is equivalent to 50 to 60 kg $NaOH/m^3$ effective alkali. When $Na_2S$ is included in the cooking liquor it is accounted for in a known manner as effective alkali, bearing in mind the effect which the prevailing sulphidity of the cooking liquor exercises on the lignin dissolution. The hydroxide is mostly consumed to the extent that about 5 kg $NaOH/m^3$ remains at the end of the cook when the temperature has normally reached 165°–175° C. On the average 3–4 $m^3$ cooking liquor per ton of moisture-free wood is charged in such cooks. According to the invention, the maintained hydroxide concentration is preferably in the range between about 10 and 30 kg $NaOH/m^3$ of cooking liquor, the actual choice depending on the cooking liquor content of other chemicals and on the selected temperature and digesting time. Actually it is now easier by means of such a predetermined and maintained hydroxide ion concentration to select temperature and reaction time with calculation of the H-factor (a technique introduced by Vroom in 1957) than in a conventional sulphate cook where the temperature is successively raised from about 90° C. to 165°–175° C. in 1–3 hours. The textbook "The Pulping of Wood" (Library of Congress Catalog Card Number 68-20994) contains tables for H-factor calculation and teaches methods for kraft batch digestion, e.g. how the H-factor relative rate changes according to the successive temperature increase up to the digestion maximum temperature (pp. 422–427).

The system employed for this invention implies that the digester contents, by means of cooking liquor maintained at the maximum temperature, reach their intended temperature in a short time and are then digested as far as required at said temperature. In this way the main cook can be carried out in about an hour or less, to which, however, must be added the time for the preceding black liquor pre-cook of chips with consumption of the cooking liquor remainder of hydroxide. It is in respect to the time intervals that the automation of digesters is of greatest value.

If in the pre-cook the exhaustion of the black liquor hydroxide is carried so far that $H_2S$ is released and also odorous sulphur compounds are given off, the chemical recovery cycle must be designed accordingly. Sulphidity sufficient for the pulp quality can, under certain conditions, be held at such a low level that the odor can be controlled. In the article "Kraft Pulping with Low Sulphidity", (Paper Trade Journal 1941, TAPPI Section, p. 103), Wells and Arnold described pre-cooks with black liquor followed by main cooks with injection of white liquor.

Pretreatment with black liquor of chips in a pre-cook can also be carried out according to the Sloman U.S. Pat. No. 2,639,987, which particularly lends itself to sulphide-free digesting of hardwood pulp, such as soda and caustic soda digesting, respectively. The acid components of the wood can thus release $CO_2$ from the black liquor remainder of noncausticized sodium carbonate while avoiding difficulties caused by otherwise released $H_2S$. In this way, a meaningful unloading of the hydroxide regeneration plant is effected.

For increased utilization of the alkaline oxygen delignification possibilities, the procedure of discharge-free alkaline pulp production in sulphur-free processes has been considered. For hardwood pulp, certain possibilities exist for achieving the same strength in paper bonding as for sulphate pulp by means of two-stage soda-caustic digesting (H. Freeman in Paper Trade Journal, Mar. 30, 1959). In this case a pre-cook with $Na_2CO_3$ is employed, after which the subsequent main cook is carried out as a caustic soda cook, i.e. with NaOH. For production of pulp from hardwoods, for example eucalyptus, delignification during digesting can be limited and replaced with oxygen delignification. It is also possible to use the oxy-liquor alkalinity for this purpose and dissolve soda smelt to prepare soda brown liquor for causticizing to produce brown liquor for caustic soda digesting. A similar process in Australia utilizes liquid phase oxidation of black liquor with oxygen, so-called wet combustion, according to Cederquist and Zimmerman, and there oxygen delignification is of course a fine supplement.

It is elsewhere shown that it is possible to reduce wood consumption in the production of kraft pulp also from softwood for a certain amount of bleached paper pulp by pretreating the chips, prior to its digestion, with cellulose yield-increasing sulphide compounds. Thereby a regeneration cycle for the sulphide compounds is preferably employed which regeneration also lowers the discharge of odorous sulphur compounds to a level even below that prevailing for conventional sulphate processes.

It is thus known that hydrosulphide and/or hydrogen sulphide in the presence of an alkaline buffering substance retains about 5–10% more cellulose in the pulp that same degree of delignification of a given amount of wood. Polysulphide pretreatment also lends itself to combination with various types of sulphide pretreatments with additive yield effect.

The attached figure shows that the yield-increasing sulphide compounds are produced in a plant 16 from $Na_2S$ and/or other sulphur compounds which have been recovered from the sulphate process spent liquors, smelt or green liquor. Sulphide liquor is charged through the digester circulation system from a vessel 17 which is optionally furnished with its own heating and circulation device 17*c*. Spent sulphide liquor is returned to the vessel 17 where appropriate sulphide concentration is maintained. (In the figure the system in which chips are treated with $H_2S$, optionally in the presence of buffering alkali, is not shown.)

The yield-increasing step is followed by the previously described black liquor step. Alternatively the black liquor step can be placed first in the program whereby the sulphide cooking liquor is mixed with the black liquor occluded in chips. In any case the black liquor withdrawal from an initial step affects the substances dissolved in the cooking liquor so that the ratio $$[\text{Oxygen-consuming substance}]/[\text{Hydroxide}] \quad (2)$$

will hold a low value in the cooking liquor system connecting the digesters 1 and 2 to the accumulator 3. The dissolved oxygen-consuming substance contains sulphides and other reducing sulphur compounds which are present in the cooking liquor of which come is discharged in the form of blow liquor and whereof a residue is occluded with the brown stock through the brown stock wash and finally is oxidized in the oxygen-stage. The lowering of the concentration of oxygen-consuming substance in the feed to the oxygen stage will avoid the breakdown of the cellulose of the oxidized pulp to lower viscosity and the formation of sulphate and thiosulphate. In that regard oxidation with oxygen of the blow liquor sulphide contents can, as early as during the digester blow, result in an advantageous effect on the development of the ratio $$\text{Kappa number reduction}/\text{Loss of viscosity} \quad (1)$$

during the oxygen stage. Oxidized blow liquor from the brown stock wash to the digester system does not smell. Similarly, oxidized black liquor withdrawn from the pre-cook is subjected to relatively small gaseous sulphur losses from the evaporation and combustion operations even in case its hydroxide was consumed in the pre-cook.

In the figure the brown stock washing step is shown as conventional wash filters or closed pressure filters. Pressure filters have advantages over vacuum filters in avoiding boiling in the use of hot wash liquids as in closed systems for bleaching, etc. Liquor displacement under liquid pressure in a continuous diffuser is advantageously combined with a filter or press device placed immediately before the oxygen reactor pulp fluffer.

It is advantageous that the incompletely washed stock be given time to undergo some leaching or diffusion in connection with the wash steps. The diffusion can advantageously be carried out during the course of a screening step. It is possible thus to discharge a fraction of screening rejects which either has properties too poor in relation to its fiber value or which without bleaching can be utilized for production of coarser paper types or other packing materials. Coarser screening rejects, knots, etc. may be disintegrated so that they can pass through presses and other washing machinery.

The oxy-stock can be screened directly and/or subsequently to optional bleaching steps. The diffusion effect in the washing is also important for extraction of oxidation products and sodium compounds before the oxy-stock is subjected to continued bleaching with chlorine bleaching agents. If it is desirable to bleach away such material in the oxy-stock which material normally would be rejected from the process in the form of screening rejects, this material can instead, preferably after disintegration, be returned to the brown stock to be subjected to repeated oxygen delignification. In this way, substances dissolved in oxy-liquor, with the material occluded are also recirculated.

Oxy-liquor 12 recovered from the oxy-stock washer contains, in addition to oxidized blow liquor residue, delignification products whose amount varies with the Kappa number or hardness of the brown stock. The digesting step and oxygen step are dependent on one another and variations of the brown stock Kappa number can cause imbalance in the entire system. According to the present invention such variations are either damped or prevented by controlling the composition of the cooking liquor to which oxy-liquor is admitted, said control being effected by means of dosage of white liquor to the cooking liquor maintained in accumulator 3.

EXAMPLE

In preference to direct measurements of conductivity and pH to govern the dosage of white liquor, via dosage valve *3e*, for maintaining hydroxide concentration in the cooking liquor accumulator, an appropriate analytical method was chosen to maintain the hydroxide concentration of one cooking liquor common to a plurality of digesters which were consecutively connected with the presurized cooking liquor accumulator. Thus each digester contained a batch of lignocellulose material with different lignin content but precolated by same cooking liquor.

Experimental injection cooks have been reported by Christiansen and Legg (Pulp and Paper Magazine of Canada, Convention Issue 1958, pp. 149–156). Because they supplied hydroxide from one source only, i.e. white liquor, they were satisfied with manual titration at 10 minute intervals using an automatic titrator set for pH 9. However according to the invention, dilution caused by oxy-liquor simultaneously lowered the hydroxide concentration of the cooking liquor. Therefore, a fully automated titration analysis as discussed by Hatton (Tappi, Vol. 56, No. 8, August 1973) was further developed on the basis of the following references:

(a) *Conductometric and potentiometric titrations* as reviewed by Sieber ("Die Chemisch-Technischen Untersuchungs--Methoden der Zellstoff- und Papier-Industrie", Berlin, Springer-Verlag 1943, pp. 154–156 and 171).

(b) *Thermometric (calorimetric) titration* and considering H-factors according to Press (Tappi, Vol. 48, No. 8, August 1965, pp. 464–466).

(c) *Continuous potentiometric titration* to a fixed end-point at pH 9.5 which was chosen according to the Tappi textbook ("Pulp and Paper Science and Technology", Vol. I, New York 1962, pp, 234 and 168–174). The principle of continuous titration shown by Wilson (Svensk Papperstidning, 1972, pp. 522–523) was applied.

The cooking liquor produced according to the invention contains less disturbing organic solids than ordinary black liquor. Thus the ultimately applied hydroxide control *3d* comprised a titration unit in which a constant flow of cooking liquor (approximately 10 liters per 24 hours) after continuous dilution with water was titrated with sulphuric acid (2N) in a flow-through vessel wherein pH 9.5 was held and then the titrated sample was led back to the accumulator. The titrant flow was directly proportional to the hydroxide concentration of liquor in the accumulator 3. Accumulator cooking liquor was pumped and distributed to each digester which had a circulation system 1*b* and 2*b* to percolate batches of lignocellulose material. The hydroxide concentration of the cooking liquor, i.e. entering the digester, was maintained at 22 kg/m$^3$ NaOH and the temperature at about 160° C. Return flow to the accumulator of cooking liquor from a just-connected digester held 10 kg/m$^3$ NaOH at 140° C. These differences between entering and returning cooking liquor successively levelled out during the progress of delignification within each consecutive batch in the series. The thus-produced fluctuations of the hydroxide concentration in the cooking liquor system around the accumulator as well as dilution caused by oxy-liquor and recycle blow liquor were thus automatically counterbalanced by impulses from the titrator 3*d* to the dosage valve 3*e* for injection of hydroxide liquor (white liquor).

The blow liquor that conveyed the brown stock through blow line 4 to the blow tank 5 showed initially the same analysis as at conclusion of the return flow of the cooking liquor into the accumulator 3. The blow liquor was subsequently recovered from the brown stock washing plant 7 by displacement with oxy-liquor 12 containing hydroxide equalling about 3 kg/m$^3$ NaOH. The main part of the mixed liquor 7*b* recovered by brown stock washing was admitted to the circulation and heating system 3*b* of the pressurized cooking liquor accumulator 3.

The dosage of white liquor hydroxide 3*e* and 14*b* to the accumulator 3 and to the oxygen reactor 9 was measured for a period of one week and totalled 19.5% NaOH based on the weight of moisture-free wood. The reactions of the cooking liquor as such consumed 14.9% NaOH calculated on the weight of wood.

From a separate pre-cook of each filling of wood chips and cooking liquor, "LOW HYDROXIDE BLACK LIQUOR" was withdrawn before the percolation with cooking liquor commenced. Black liquor amounting to 5 m$^3$ per ton of bleached pulp (metric ton air-dry basis) containing 16.5% solids was passed directly to the evaporation plant 13 via line 17*b*.

In the low hydroxide black liquor only between 0 and 1 kg/m$^3$ NaOH remained. The overall low value for hydroxide consumption was achieved in the pre-cook by allowing cooking liquor containing oxy-liquor hydroxide releasing alkali compounds to neutralize the acid components of the lignocellulose material prior to discharge of oxy-liquor substances as one of several black liquor components.

The Kappa numbers of brown stock and oxy-stock were 57 and 23 respectively. The intrinsic viscosity of the oxy-stock was 990 cm$^3$/g and that of bleached stock, i.e. the final pulp, 940 cm$^3$/g.

The bleached stock brightness was 94 SCAN-units. The lignocellulose material, i.e. wood chips of pine and spruce, was in a yield-increasing step pretreated with polysulphide from plant 16 and storage tank 17. The weight of bleached stock amounted to 56% of the weight of wood on a moisture-free basis.

During this period of the trial runs, said hydroxide concentration and cooking liquor temperature were maintained as measured in the accumulator pipelines. For practical reasons the temperatures inside the digesters during the black liquor forming pre-cook and from start to equilibrium of cooking liquor percolation were not recorded with the accuracy required to calculate true Vroom H-factors. The apparent H-factor was 20 in the black liquor stage and upon connection to the accumulator cooking liquor system it rose to 600. However, a conventional cooking to a Kappa number of 30 with the cooking hydroxide concentration falling from approximately 60 to 5 kg/m$^3$ NaOH liquor, when the final or maximum temperature has been reached, requires an H-factor of about 1400 depending on conditions for each charge of individual digesters. The nondependence on true H-factor computation distinguishes this invention from control methods based on one characteristic hydroxide titration value for each of all the cooks.

The invention has been described with examples from the digestion of kraft (sulphate) and caustic soda pulps. Other digesting processes which require control of the sodium-based cooking liquor hydroxide ion concentration according to the invention are respectively alkaline and neutral sulphite digesting of semi-chemical and/or high yield pulps. These processes with sulphite-containing cooking liquor in digesting according to the sulphate- or soda pulp processes are considered very well suited to continued pulp delignification with oxygen and alkali. Thus, the terms black liquor and white liquor refer to the corresponding spent cooking liquor and cooking liquid. Said processes for digesting in the presence of sulphite should not be confused with the acid sulphite digesting processes.

I claim:

1. In a method for batch pulp digestion of lignocellulose material with a hydroxide-bearing cooking liquid, in combination with continuous alkaline oxygen delignification comprising an oxygen-alkali process in subsequent pulp bleaching in a sequence of one or several steps, from which oxygen-alkali waste liquor having sodium compounds worth recovering and dissolved combustible lignin products is recovered via a brown stock washing step in such a way that oxygen-alkali waste liquor joins black liquor which is obtained by pulping of the material to a predetermined Kappa number, said pulping being controlled in part by the chemical charge to a predetermined hydroxide concentration in the cooking liquor and in part by the H-factor so that the subsequent oxygen delignification comprising said oxygen-alkali process can take place with small cellulose degradation and to the greatest extent constant composition of the recovered oxygen-alkali waste liquor comprising said oxygen-alkali waste liquor, pulping the lignocellulose material in a plurality of intermittent digesters using the hydroxide-bearing cooking liquor containing oxygen-consuming substances to produce brown stock, batchwise removing raw brown stock from said digesters, washing said raw brown stock with waste liquor from the oxygen-alkali process, contacting said washed brown stock with oxygen to effect oxygen delignification of said brown stock thereby to produce oxygen-alkali bleached pulp, removing oxygen-alkali waste liquor from said bleached pulp, using a first portion of the last-named waste liquor as said waste liquor in said raw brown stock washing step, removing a first portion of spent black liquor containing oxygen-consuming substances from said digesters and regenerating the same to produce hydroxide-bearing white liquor, feeding a second portion of said spent black liquor to a cooking liquor accumulator common to said plural digesters, feeding a second portion of said oxygen-alkali waste liquor to said cooking liquor accumulator, feeding a portion of said white liquor to said cooking liquor accumulator, measuring the hydroxide concentration by continuous analysis of said cooking liquor of said accumulator, and controlling the dosage of said white liquor to said accumulator in response to said hydroxide concentration measurement so as to maintain the hydroxide concentration of said cooking liquor substantially constant and to maintain a low value of the ratio oxygen-consuming substances/hydroxide in said cooking liquor; the improvement comprising removing the raw brown stock from said digesters by blowing whereby the raw brown stock is conveyed by blow liquor, feeding a portion of said blow liquor continuously to said cooking liquor accumulator, feeding cooking liquor from said cooking liquor accumulator to said digesters as said cooking liquor in said digesting step, and conveying from said digesting step each removed batch of raw brown stock and cooking liquor by the blow liquor whereof a residue is occluded with the feed of said washed brown stock to said oxygen-alkali delignification process.

2. A method as claimed in claim 1, in which a portion of said waste liquor from the oxygen-alkali delignification process is fed to said regeneration step which produces hydroxide-bearing white liquor from said spent black liquor.

3. A method as claimed in claim 1, in which blow liquor from said brown stock washing step is fed to said white liquor regeneration step which produces hydroxide-bearing white liquor from said spent black liquor.

4. A method as claimed in claim 1, in which causticized brown liquor prepared from liquor obtained from said brown stock washing step is also fed to said cooking liquor accumulator.

5. A method as claimed in claim 1, and maintaining the cooking liquor in said accumulator at a temperature between 150° and 180° C.

6. A method as claimed in claim 1, and feeding to said oxygen delignification step a further portion of said hydroxide-bearing white liquor.

7. A method as claimed in claim 1, and feeding black liquor from a separate digester outlet directly to an evaporation plant.

* * * * *